US006160467A

United States Patent [19]

Teimorzadeh et al.

[11] Patent Number: 6,160,467

[45] **Date of Patent: *Dec. 12, 2000**

[54] TRANSFORMER WITH CENTER TAP

[75] Inventors: Mehrdad Teimorzadeh, Troy; John Bernard Huss, Ann Arbor, both of Mich.

[73] Assignee: Visteon Global Technologies, Inc., Dearborn, Mich.

[ * ] Notice: Under 35 U.S.C. 154(b), the term of this patent shall be extended for 670 days.

[21] Appl. No.: 08/513,106

[22] Filed: Aug. 9, 1995

[51] Int. Cl.[7] ..... H01F 27/30

[52] U.S. Cl. ..... 336/180; 336/183; 336/223; 336/225

[58] Field of Search ..... 336/223, 182, 336/183, 225, 180, 174

[56] References Cited

U.S. PATENT DOCUMENTS

| | | | |
|---|---|---|---|
| 2,860,312 | 11/1958 | Krepps, Jr. | 336/223 |
| 4,176,335 | 11/1979 | Charpentier | 336/180 |
| 4,200,853 | 4/1980 | de Jong et al. . | |
| 4,748,405 | 5/1988 | Brodzik et al. | 336/174 |
| 4,748,430 | 5/1988 | Guais | 336/225 |
| 4,855,552 | 8/1989 | Marceau et al. . | |
| 4,901,048 | 2/1990 | Williamson . | |
| 5,034,717 | 7/1991 | Shinkai . | |
| 5,128,511 | 7/1992 | Stanisz . | |
| 5,179,365 | 1/1993 | Raggi . | |
| 5,182,536 | 1/1993 | Boylan et al. . | |
| 5,216,402 | 6/1993 | Carosa . | |
| 5,331,536 | 7/1994 | Lane . | |

OTHER PUBLICATIONS

IBM Technical Disclosure Bulletin, "Flat Winding Transformer", J. K. Radcliffe, vol. 22, No. 9 Feb. 1980, pp. 4009–4012.

*Primary Examiner*—Thomas J. Kozma
*Attorney, Agent, or Firm*—Mark L. Mollon

[57] ABSTRACT

In one embodiment of the present invention, a transformer includes a first secondary winding made of stamped and bent metal. This first secondary winding has a coil portion with substantially closed cross section. The transformer also includes a primary winding made of wire and having a coil portion wound around the coil portion of the first secondary winding. A second secondary winding made of stamped and bent metal and having a coil portion with substantially closed cross section has its coil portion disposed about the coil portion of the primary winding. The primary winding further includes a second coil portion wound around the coil portion of the second secondary winding. The transformer thus provided is easier to build and less apt to internal short-circuiting than alternative designs.

9 Claims, 3 Drawing Sheets

TRANSFORMER WITH CENTER TAP

BACKGROUND OF THE INVENTION

1. Field of the Invention

The present invention relates to transformers.

2. Description of the Related Art

Transformers are used to transform one voltage into another. One application for transformers is in an electric vehicle. There, the power source for the vehicle, the "traction batteries", typically has a voltage of several hundred volts. However, conventional electrical and electronic accessories on the vehicle are designed to operate at a nominal voltage of 12 volts. A DC-to-DC converter containing a transformer is used to step the traction battery voltage down to a nominal 12 volts. In such an application, the transformer must be capable of supplying large currents, typically several tens of amperes.

Transformers for this type of high-current application are typically designed with windings made of copper foil. Several turns of copper foil are wound around the magnetic core of the transformer in a painstaking and expensive process. At appropriate places on the foil windings, braided conductors are soldered. These braided conductors are then connected to terminals of the transformer. Soldering the braided conductors onto the foil and onto the terminals are also slow, and therefore expensive, processes.

An additional concern in a typical transformer is that one of the foil windings will electrically short to itself or to another of the foil windings. This concern is due to burrs which are typically left on the foil when it is fabricated. Although the foil is insulated with, for example, plastic film before being wound to form the coils of the transformer, burrs left on the foil can pierce the insulation and nonetheless cause short circuits.

In light of the difficulties encountered in fabricating a conventional transformer, a transformer design which lends itself to fabrication in a more convenient way will provide cost advantages over the prior art. Further, a transformer design which is less apt to having short circuits will provide quality advantages over prior art designs.

SUMMARY OF THE INVENTION

The present invention provides a transformer comprising a first winding having a coil portion with a substantially closed cross section, the coil portion comprising metal of sufficient thickness to hold the substantially closed cross section with no external force. The transformer further includes a second winding having a coil portion thereof wound around the coil portion of the first winding.

The present invention also provides a second transformer. The transformer comprises a first winding having a coil portion with a substantially closed cross section, the coil portion comprising metal of sufficient thickness to hold the substantially closed cross section with no external force. Also, the transformer includes a second winding having a coil portion thereof wound in a magnetically-coupled relationship with the coil portion of said first winding.

The present invention also provides a method for constructing a transformer. The method includes the step of bending a first piece of metal into a predefined shape to form a first winding, the metal of sufficient thickness to retain the predefined shape without any external force, the first winding having a coil portion with a substantially closed cross section. The method also comprises the step of winding wire around the coil portion of the first winding to form a coil portion of a second winding.

The present invention provides a transformer which is easier to build than alternative designs and which is less apt to short circuits than alternative designs. These characteristics provide advantages over the prior art.

BRIEF DESCRIPTION OF THE DRAWINGS

FIG. 9 also shows the connection of transformer 20 to two two-diode rectifier assemblies 48.

DETAILED DESCRIPTION OF THE PREFERRED EMBODIMENT

Figure 9:
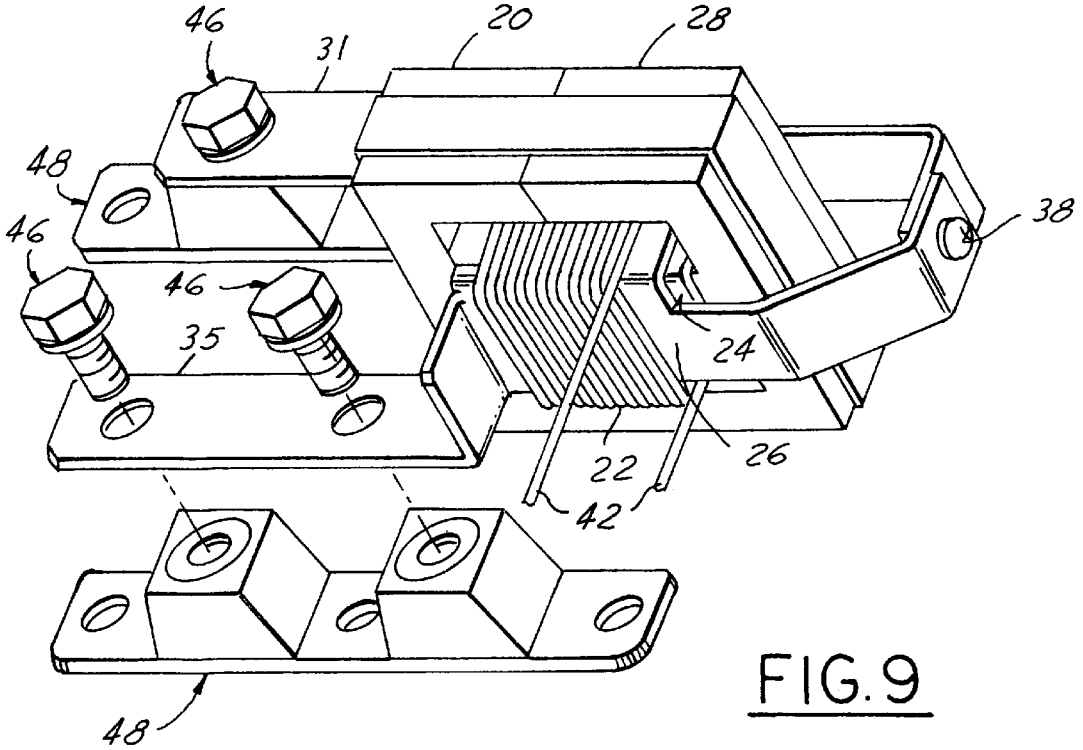
FIG. 9 is a fully-assembled view of transformer 20.

Referring to FIG. 9, a transformer 20 according to one embodiment of the present invention will be described. Transformer 20 comprises a primary winding 22, a first secondary winding 24 and a second secondary winding 26. Transformer 20 further comprises magnetic core 28. Transformer 20 is designed to convert a voltage in primary winding 22 to voltages in first secondary winding 24 and second secondary winding 26.

Figure 1:
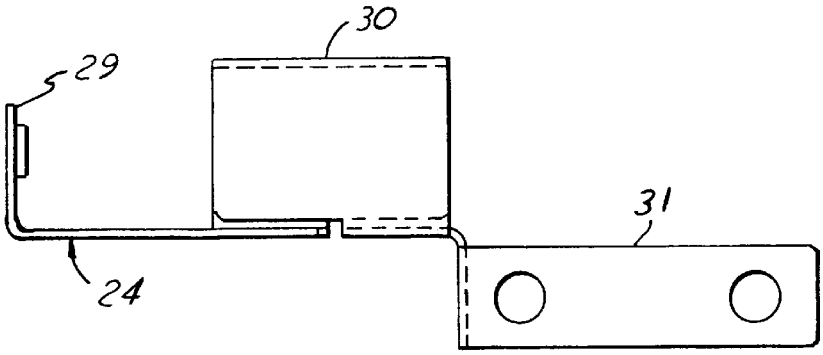
FIG. 1 is a top view of a first secondary winding 24 of a transformer 20 according to one embodiment of the present invention.
Figure 2:
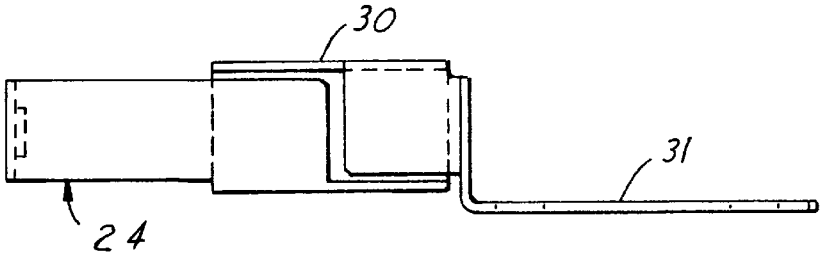
FIG. 2 is a side view of first secondary winding 24.
Figure 6:
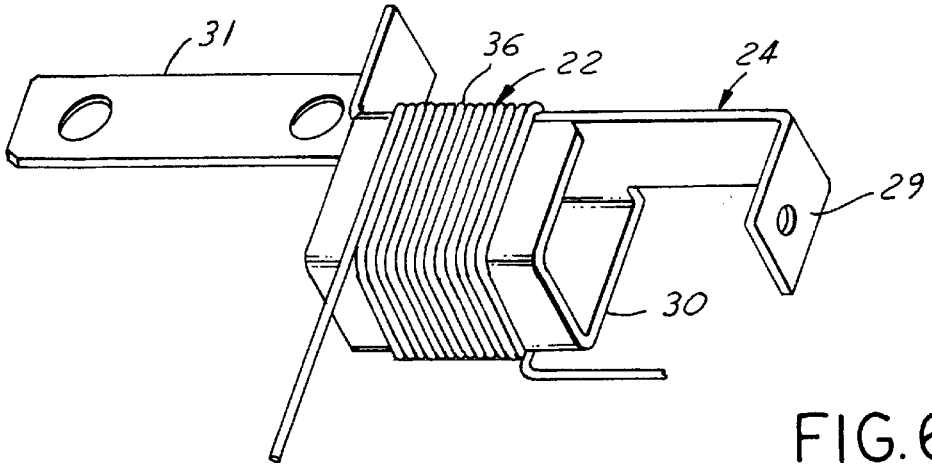
FIG. 6 is a partially-assembled view of transformer 20 according to one embodiment of the present invention.

Referring now to FIGS. 1, 2 and 6, first secondary winding 24 will be described in further detail. First secondary winding 24 is constructed of metal, preferably 0.032" thick tin-plated copper. First secondary winding 24 is preferably stamped out of the metal and then bent into the shape shown in FIGS. 1, 2 and 6. First secondary winding 24 comprises a coil portion 30 having a substantially closed cross section. It is in this coil portion 30 that a voltage is developed in secondary winding 24. Coil portion 30 is preferably electrically insulated on the inside and the outside. This insulation can be provided, for example, by "powder spraying" an electrically insulating material on coil portion 30, or by coating coil portion 30 with epoxy.

As shown in FIGS. 1, 2 and 6, coil portion 30 has one turn. However, coil portion 30 can also have more than one turn. The turns can be arranged, for example, in an axial relationship with one another. Modifying the shape into which first secondary winding 24 is initially stamped and then ultimately bent can provide these additional turns.

First secondary winding 24 has two ends 29 and 31.

First secondary winding 24 is preferably formed of a single piece of metal. Further, coil portion 30 of first secondary winding 24 is of sufficient thickness such that the shape of coil portion 30 is held after bending without the application of any external force. This "sufficient thickness" can be contrasted with prior-art transformer windings made of metallic foil, which cannot hold their final shape without adhesive, tape or other means for exerting an external force.

Figure 3:
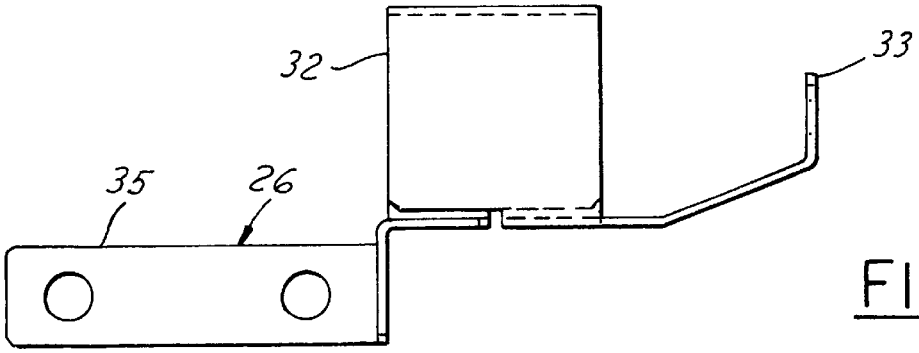
FIG. 3 is a top view of a second secondary winding 26 of transformer 20.
Figure 4:
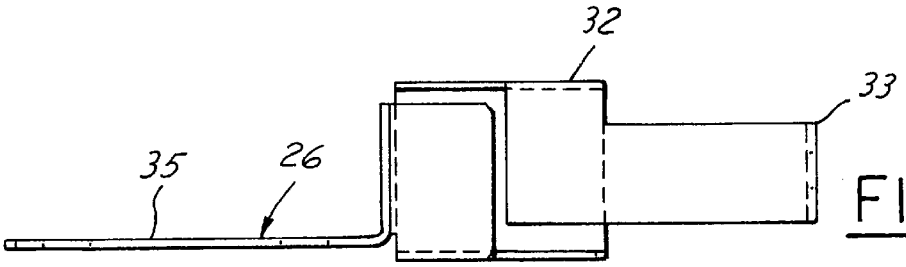
FIG. 4 is a side view of second secondary winding 26.
Figure 7:
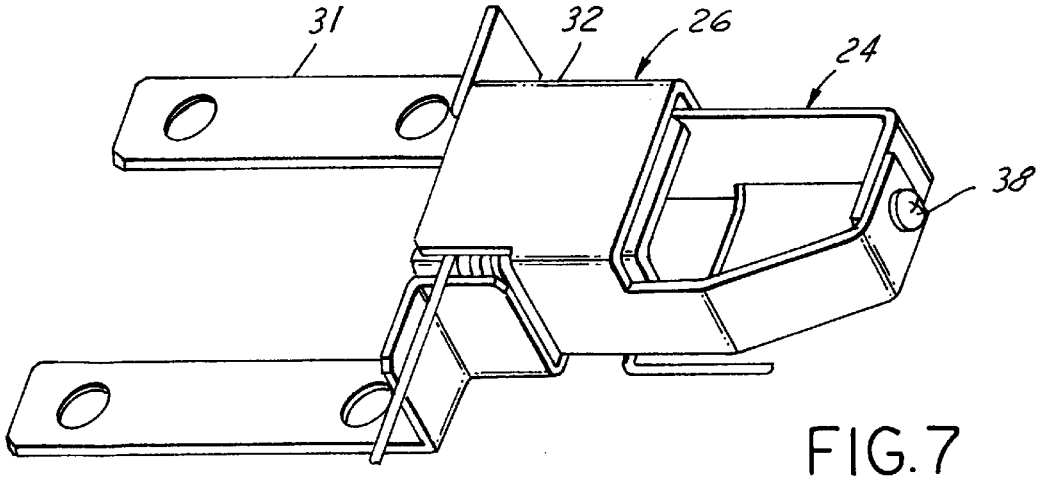
FIG. 7 is a second partially-assembled view of transformer 20.

Referring now to FIGS. 3, 4 and 7, second secondary winding 26 will be described in detail. Second secondary winding 26 is constructed of metal, preferably 0.032" thick tin-plated copper. Second secondary winding 26 is preferably stamped out of the metal and then bent into the shape shown in FIGS. 3, 4 and 7. Second secondary winding 26 has a coil portion 32 with a substantially closed cross section. As with first secondary winding 24, coil portion 32 of second secondary winding 26 has a single turn. However, as with first secondary winding 24, coil portion 32 of second secondary winding 26 can have multiple turns.

Second secondary winding 26 has two ends 33 and 35.

Second secondary winding 26 is preferably made of a single piece of metal. Further, coil portion 32 of secondary winding 26 is of sufficient thickness such that coil portion 32 will retain its shape after bending without the need for external force.

Figure 5:
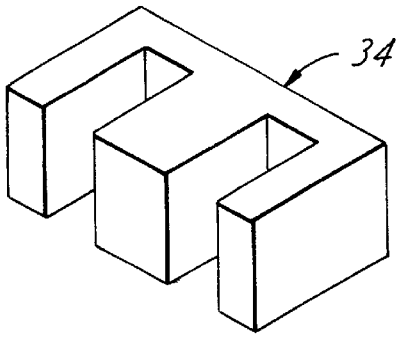
FIG. 5 is a perspective view of one of two half-cores 34 of transformer 20 according to one embodiment of the present invention.

Magnetic core 28 will now be described with reference to FIGS. 5 and 9. Magnetic core 28 preferably comprises two "E"-shaped half-cores 34 constructed of a ferromagnetic material, preferably iron.

The construction of transformer 20 will now be described, first with reference to FIG. 6. Around coil portion 30 of first secondary winding 24 is wound a portion of the wire of primary winding 22. After this winding occurs, the ends of the wire are left as shown in FIG. 6. The portion of the wire wound around coil portion 30 of first secondary winding 24 thus forms a coil portion 36 of primary winding 22.

If needed to help hold coil portion 36 of primary winding 22 in place, a bobbin can be provided around coil portion 30 of first secondary winding 24, coil portion 36 being wound on the bobbin. Further, varnish or tape can be applied to coil portion 36 to help hold it in place.

With reference now to FIG. 7, second secondary winding 26 is introduced such that coil portion 32 of second secondary winding 26 is disposed about coil portion 36 of primary winding 22 and coil portion 30 of first secondary winding 24. End 29 of first secondary winding 24 and end 33 of second secondary winding 26 are coupled with a screw 38 such that this coupling provides electrical conductivity between first secondary winding 24 and second secondary winding 26.

Figure 8:
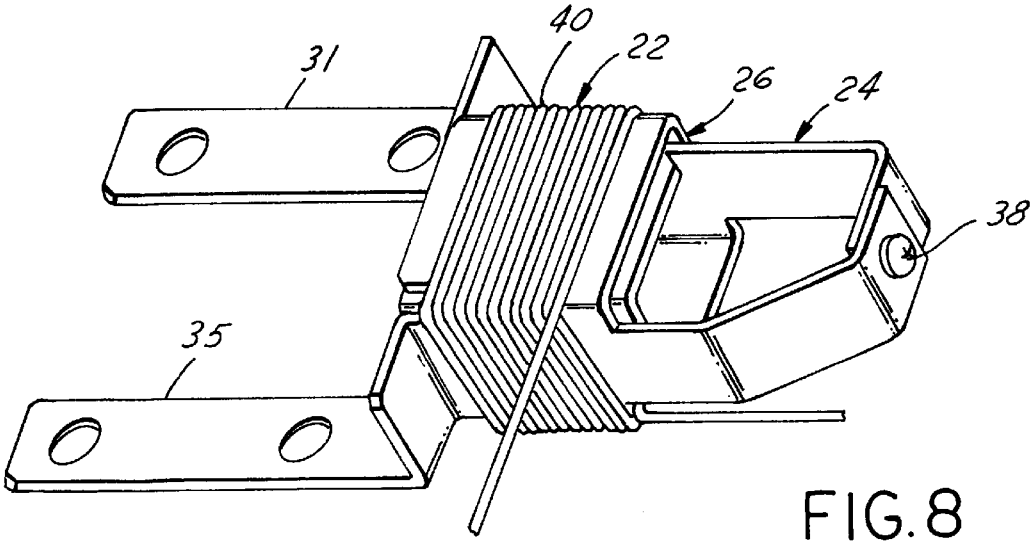
FIG. 8 is a third partially-assembled view of transformer 20.

With reference now to FIG. 8, the wire which forms primary winding 22 continues to be wound, now about coil portion 32 of second secondary winding 26. The portion of the wire around coil portion 32 of secondary winding 26 thus forms a coil portion 40 of primary winding 22. As with coil portion 36 of primary winding 22, a bobbin, varnish and/or tape can be used to help hold coil portion 40 in place.

Referring now to FIG. 9, core half-portions 34 are added to the assembly and banded together using tape or other suitable banding material. The ends 42 of the wire which forms primary winding 22 extend outward as shown, for connection as appropriate to, for example, a circuit board.

End 31 of first secondary winding 24 forms an output terminal of transformer 20, as does end 35 of second secondary winding 26. Each output terminal can be connected via two bolts 46 to a two-diode rectifier assembly 48, such as the MURP2002OCT from Motorola Corporation. Further, screw 38, which holds first secondary winding 24 and second secondary winding 26 together, provides a "center-tap" connection for the output of transformer 20.

Figure 10:
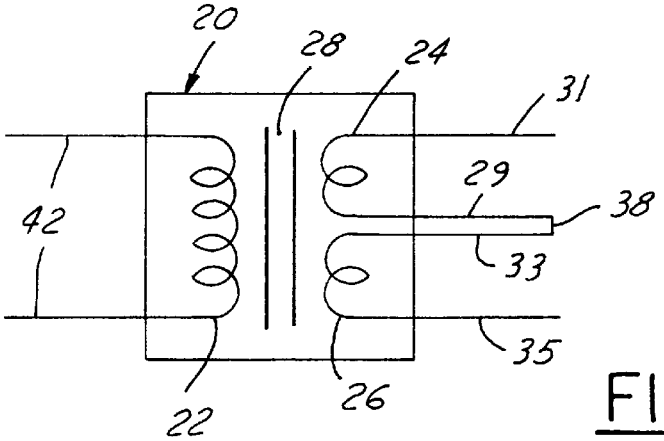
FIG. 10 is an electrical schematic of transformer 20.

A circuit diagram for transformer 20 according to this embodiment of the present invention is shown in FIG. 10.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A transformer comprising:

a first winding comprising a coil portion with a substantially closed cross section, said coil portion comprising metal of sufficient thickness to hold said substantially closed cross section with no external force;

a second winding having a coil portion thereof wound around said coil portion of said first winding;

a third winding comprising a coil portion with a substantially closed cross section, said coil portion comprising metal of sufficient thickness to hold said substantially closed cross section with no external force, wherein said coil portion is disposed about said coil portion of said second winding;

wherein said first winding and said third winding are mechanically and electrically coupled with a fastener which forms a center tap.

2. A transformer as recited in claim 1, wherein:

said first winding has a metallic output terminal; and said output terminal and said coil portion of said first winding are constructed from a single piece of metal.

3. A transformer as recited in claim 2, wherein:

said third winding has a metallic output terminal; and said output terminal and said coil portion of said third winding are constructed from a single piece of metal.

4. A transformer as recited in claim 3, wherein:

said substantially closed cross section of said coil portion of said first winding is rectangular; and said coil portion of said first winding comprises copper at least 0.032" thick.

5. A transformer as recited in claim 4, wherein:

said substantially closed cross section of said coil portion of said third winding is rectangular; and said coil portion of said third winding comprises copper at least 0.032" thick.

6. A transformer comprising:

a first winding comprising a coil portion with a substantially closed cross section, said coil portion comprising metal of sufficient thickness to hold said substantially closed cross section with no external force;

a second winding having a coil portion thereof wound in a magnetically-coupled relationship with said coil portion of said first winding;

a third winding comprising a coil portion with a substantially closed cross section, said coil portion comprising metal of sufficient thickness to hold said substantially closed cross section with no external force;

wherein said coil portion is disposed about said coil portion of said first winding; and wherein said first winding and third winding are mechanically and electrically coupled with a fastener which forms a center tap.

7. A transformer as recited in claim 6, wherein:

said first winding has a metallic output terminal;

said output terminal of said first winding and said coil portion of said first winding are constructed from a single piece of metal;

said third winding has a metallic output terminal; and said output terminal of said third winding and said coil portion of said third winding are constructed from a single piece of metal.

8. A transformer as recited in claim 1, wherein said fastener is a screw.

9. A transformer as recited in claim 6, wherein said fastener is a screw.

* * * * *